US008931676B2

(12) United States Patent
Braddock

(10) Patent No.: US 8,931,676 B2
(45) Date of Patent: Jan. 13, 2015

(54) NAILER HAVING MECHANISM FOR PRE-POSITIONING NAIL

(75) Inventor: C. Kerwin Braddock, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 1265 days.

(21) Appl. No.: 12/189,329

(22) Filed: Aug. 11, 2008

(65) Prior Publication Data

US 2009/0057366 A1 Mar. 5, 2009

Related U.S. Application Data

(60) Provisional application No. 60/968,210, filed on Aug. 27, 2007.

(51) Int. Cl.

*B25C 1/00* (2006.01)
*B25C 1/06* (2006.01)
*B25C 7/00* (2006.01)

(52) U.S. Cl.

CPC ..... *B25C 1/005* (2013.01); *B25C 1/008* (2013.01); *B25C 1/06* (2013.01); *B25C 7/00* (2013.01)

USPC ..... 227/119; 227/107; 227/120

(58) Field of Classification Search

CPC ..... B25C 1/003; B25C 1/005; B25C 1/006; B25C 1/008; B25C 5/1696; B25C 1/182; B25C 1/184

USPC ..... 227/107, 110, 119, 120

See application file for complete search history.

(56) References Cited

U.S. PATENT DOCUMENTS

| | | | | | |
|---|---|---|---|---|---|
| 1,726,012 | A | * | 8/1929 | Bilz | 227/147 |
| 2,896,209 | A | * | 7/1959 | Hilti | 227/147 |
| 4,003,417 | A | * | 1/1977 | Cornwell | 81/57.37 |
| 4,126,258 | A | * | 11/1978 | Martin et al. | 227/8 |
| 4,195,762 | A | * | 4/1980 | Burton | 227/156 |
| 4,454,650 | A | * | 6/1984 | Silver | 29/818 |
| 4,801,062 | A | | 1/1989 | Austin | |
| 4,903,880 | A | | 2/1990 | Austin et al. | |
| 5,234,147 | A | * | 8/1993 | Greenwalt | 227/149 |
| 5,238,167 | A | * | 8/1993 | Howard et al. | 227/110 |
| 5,316,200 | A | * | 5/1994 | Wallin | 227/119 |
| 5,579,975 | A | | 12/1996 | Moorman | |
| 5,803,338 | A | | 9/1998 | Singer et al. | |
| 5,810,239 | A | * | 9/1998 | Stich | 227/119 |
| 5,927,585 | A | | 7/1999 | Moorman et al. | |
| 6,431,428 | B1 | | 8/2002 | Chen et al. | |
| 6,488,195 | B2 | | 12/2002 | White et al. | |
| 6,499,643 | B1 | | 12/2002 | Hewitt | |

(Continued)

*Primary Examiner* — Gloria R Weeks

(74) *Attorney, Agent, or Firm* — Harness, Dickey & Pierce, P.L.C.

(57) ABSTRACT

A fastening tool can include a housing comprising a nosepiece and a handle. The handle can define a first longitudinal axis. A magazine can be connected to the housing for storing a fastener. The magazine can define a second longitudinal axis that is substantially parallel to the first longitudinal axis and a fastener channel for receiving a fastener. The magazine can be movable relative to the housing between an alignment position wherein the distal tip of the fastener engages a workpiece and an activation position wherein the magazine moves toward the housing upon movement of the handle toward the workpiece. A driving mechanism can be disposed within the housing for driving the fastener into a workpiece. A trigger assembly can be coupled to the housing for activating the driving mechanism upon actuation of a primary trigger and movement of the magazine into the activation position.

25 Claims, 7 Drawing Sheets

(56) References Cited

U.S. PATENT DOCUMENTS

| | | | | |
|---|---|---|---|---|
| 6,578,749 | B1 * | 6/2003 | Shen et al. | 227/119 |
| 6,609,646 | B2 | 8/2003 | Miller et al. | |
| 6,705,501 | B2 | 3/2004 | Miller et al. | |
| 6,808,101 | B2 * | 10/2004 | Laubach et al. | 227/109 |
| 6,820,788 | B2 * | 11/2004 | Akiba | 227/8 |
| 6,880,739 | B1 | 4/2005 | Zhu et al. | |
| 7,000,817 | B1 * | 2/2006 | Wang | 227/109 |
| 7,017,790 | B1 * | 3/2006 | Peng | 227/119 |
| 7,137,541 | B2 | 11/2006 | Baskar et al. | |
| 7,175,064 | B2 | 2/2007 | Schell et al. | |
| 7,628,304 | B2 * | 12/2009 | Yamamoto et al. | 227/8 |
| 2001/0054635 | A1 * | 12/2001 | Schmitz | 227/15 |
| 2006/0091177 | A1 | 5/2006 | Cannaliato et al. | |
| 2007/0075113 | A1 * | 4/2007 | Tillinghast et al. | 227/130 |
| 2007/0095875 | A1 | 5/2007 | Lamb | |
| 2008/0302850 | A1 * | 12/2008 | Kumayama | 227/120 |

* cited by examiner

NAILER HAVING MECHANISM FOR PRE-POSITIONING NAIL

CROSS-REFERENCE TO RELATED APPLICATIONS

This application claims the benefit of U.S. Provisional Application No. 60/968,210, filed on Aug. 27, 2007. The disclosures of the above applications are incorporated herein by reference.

FIELD

The present disclosure relates to power tools, and more particularly to a positive placement device for a power tool for aligning a fastener with a workpiece prior to driving the fastener into the workpiece.

BACKGROUND

Fastening tools, such as nailers and staplers, are relatively commonplace in the construction trades. Many features of typical fastening tools, while adequate for their intended purpose, do not provide the user with a desired degree of flexibility and function. For example, in some applications, metal connectors or steel straps must be secured to a workpiece. The steel straps are steel plates with existing holes for fasteners to locate through. In some instances it may be difficult to properly align a nosepiece or contact trip of a fastening tool with the intended hole of the steel strap prior to driving the fastener. Accordingly, there remains a need in the art for an improved fastening tool.

SUMMARY

A fastening tool can include a housing comprising a nosepiece and a handle. The handle can define a first longitudinal axis. A magazine can be connected to the housing for storing a fastener. The magazine can define a firing slot and a stabilizing surface. The magazine can further define a second longitudinal axis that is substantially parallel to the first longitudinal axis and a fastener channel for receiving a fastener. The magazine can be movable relative to the housing between an alignment position wherein the distal tip of the fastener engages a workpiece and an activation position wherein the magazine moves toward the housing upon movement of the handle toward the workpiece. The fastener can be guided along the firing slot to an engaged position with the stabilizing surface during movement from the alignment position to the activation position. A driving mechanism can be disposed within the housing that advances through the firing slot for driving the fastener into a workpiece. A trigger assembly can be coupled to the housing for activating the driving mechanism upon actuation of a primary trigger and movement of the magazine into the activation position.

According to additional features, the first and second longitudinal axes maintain a substantially parallel relationship upon movement of the magazine toward the housing. The fastener channel can be at least partially defined by a rail configured to receive a head of the fastener. The stabilizing surface can be configured to only engage a forward-most fastener of a series of fasteners. The stabilizing surface can engage a fastener head during movement of the magazine from the alignment position to the activation position. In one example, the stabilizing surface can be substantially perpendicular to an axis defined by the fastener. The magazine can be biased toward the alignment position.

According to still additional features, the magazine can define a first piston and the nosepiece can define a first bore. The first piston can slidably translate within the first bore during movement of the magazine between the alignment position and the activation position. A second bore can be defined on a foot of the fastening tool. The second bore can receive a second piston defined on the magazine. The second piston can slidably translate within the second bore during movement of the magazine between the alignment position and the activation position.

A fastening tool according to other features can include a housing and a magazine connected to the housing for storing a fastener. A driver can be disposed within the housing for driving the fastener into a workpiece. A trigger assembly can be coupled to the housing for activating the driver. The trigger assembly can include a main trigger coupled to the housing and a supplemental trigger coupled to the main trigger. A contact trip can be configured to communicate with the trigger assembly to move at least one of the main trigger and the supplemental trigger. A jaw assembly comprising a first and a second jaw can be pivotally coupled to and extending beyond a distal tip of the contact trip. The first and the second jaws pivotally expand upon driving a fastener therebetween.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 14:
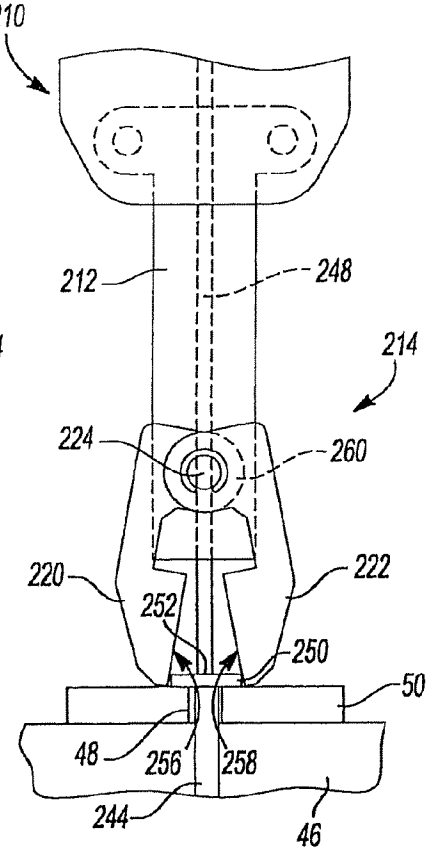
Figure 13:
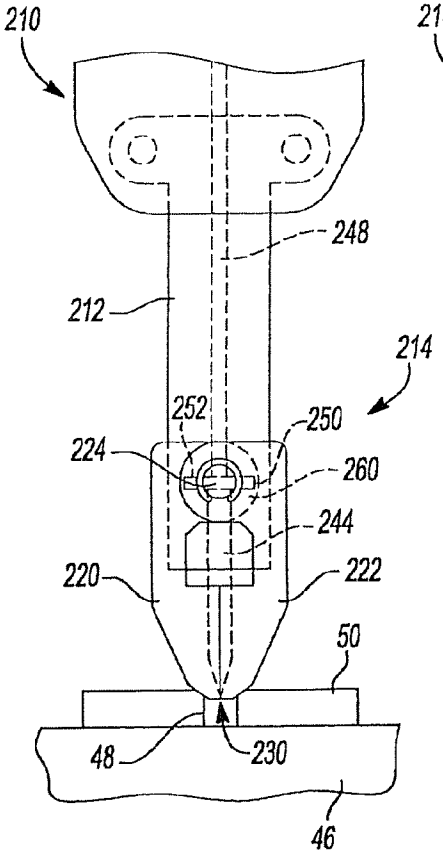
Figure 12:
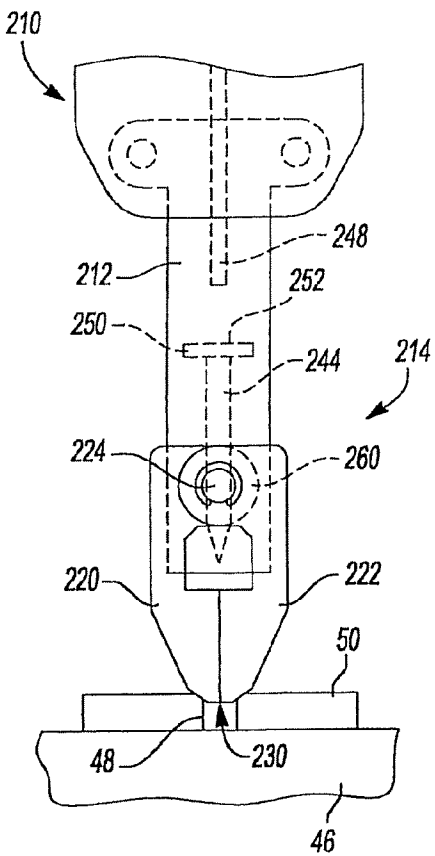
FIG. 12 is a side perspective view of a jaw assembly located at a hole in a steel strap and cooperating with a contact trip according to additional features of the instant disclosure.

FIG. 13 is a side perspective view of the jaw assembly of FIG. 12 and shown with a fastener being driven by a driver to an intermediate position; and FIG. 14 is a side perspective view of the jaw assembly of FIG. 13 and shown with the fastener driven to a final position, the jaw members of the jaw assembly being urged pivotally outward upon slidable advancement of head of the fastener along the jaw members.

DETAILED DESCRIPTION

Figure 1:
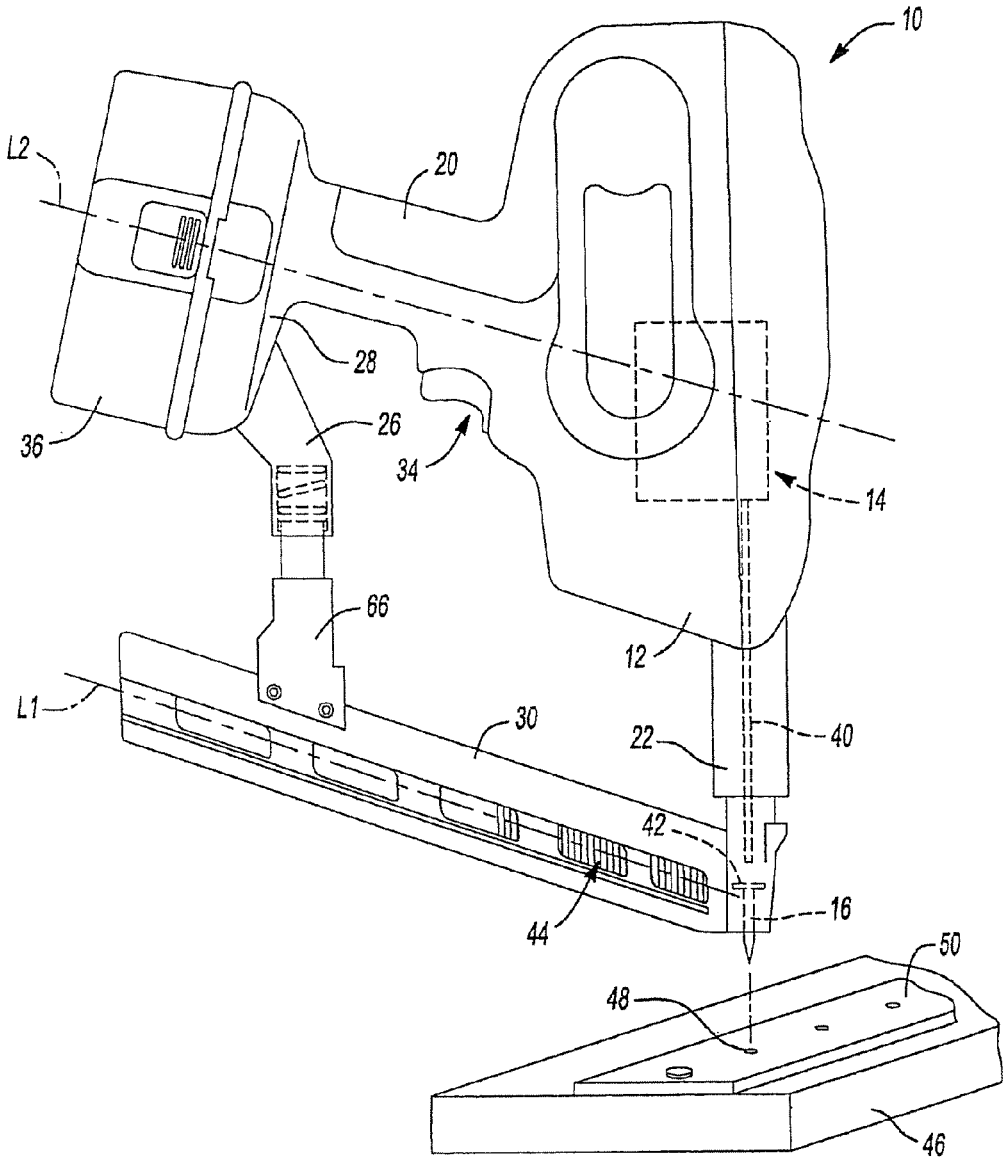
FIG. 1 is a perspective view of an exemplary cordless fastening tool constructed in accordance with the teachings of the present disclosure.
Figure 2:
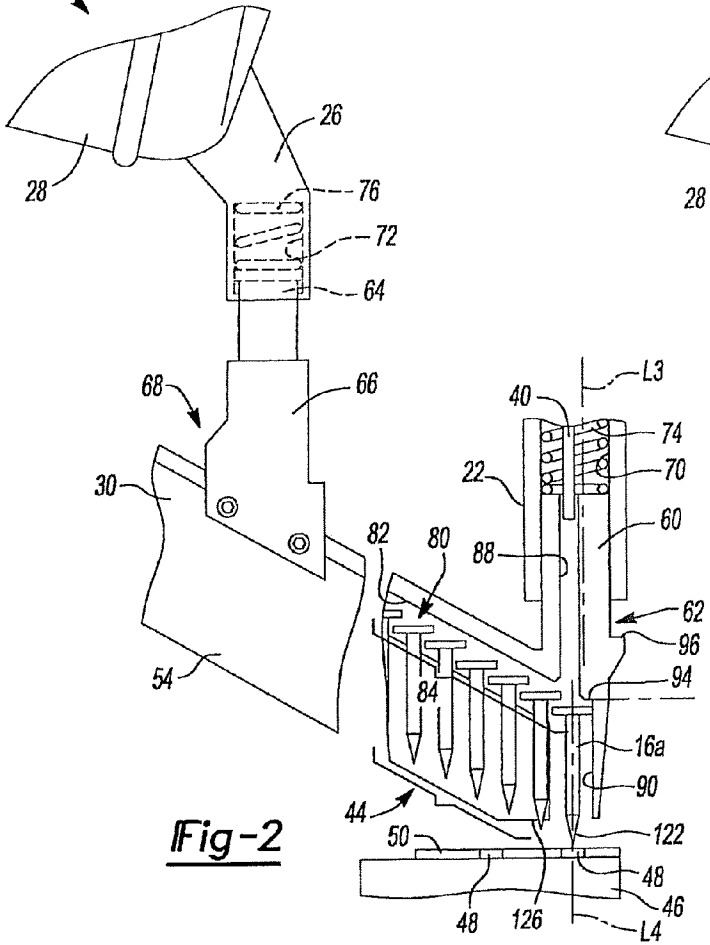
FIG. 2 is a partial perspective view of a magazine and a foot portion of the fastening tool, the magazine shown partially cutaway with a forward-most fastener located generally above a steel strap and a workpiece.

With initial reference to FIGS. 1 and 2, an exemplary fastening tool constructed in accordance with the present teachings is shown and generally identified at reference numeral 10. The fastening tool 10 can include a housing 12 which covers a driving mechanism 14 for driving a fastener 16, such as a nail. The housing 12 can include a handle 20, a nosepiece 22 below the housing 12, and a foot 26 extending from a base 28 of the housing 12. A fastener magazine 30 can be connected to the housing 12 at the nosepiece 22 and the foot 26. A trigger assembly 34 can be disposed on the housing 12 and/or the handle 20 for activating the driving mechanism 14. Persons skilled in the art should recognize that the driving mechanism 14 can be a pneumatic-based system, such as the ones shown in commonly owned U.S. Pat. No. 5,181,450, or an electric system, such as the one shown in commonly owned U.S. Pat. No. 4,928,868. The teachings from those patents are wholly incorporated herein by reference. The fastening tool 10 can also be a combustion based fastening tool or any type of power assisted fastening device. The fastening tool 10 according to this disclosure is an electric system having a battery 36 removably coupled to the base 28 of the housing 12.

A motor (not shown) can drive a transmission (not shown), which, in turn can actuate the driving mechanism 14. Actuation of the driving mechanism 14 can advance a driver 40 that strikes a head 42 of a forward-most fastener 16A (FIG. 2). The fasteners, collectively referred to at reference number 44, may be sequentially fed from the fastener magazine 30 into the nosepiece 22, and into a workpiece 46. As will become appreciated, the fastener tool 10 may be particularly useful for driving a fastener 44 through a predefined hole 48 in a metal connector or steel strap 50. It is appreciated however that the fastening tool 10 is not limited to such applications.

With reference to FIGS. 1-8, the fastener magazine 30 will be described. The fastener magazine 30 generally defines a horizontal magazine housing 54. In one example, the horizontal magazine housing 54 can define a longitudinal axis L1 (FIG. 1) that is substantially parallel to a longitudinal axis L2 (FIG. 1) defined by the handle 20 of the housing 12. The horizontal magazine housing 54 can define a first piston 60 (FIG. 2) configured on a forward end 62 and a second piston 64 defined on a strut 66 coupled to a rearward end 68. The first piston 60 can be slidably received within a first bore 70 defined on the nosepiece 22. The second piston 64 can be slidably received within a second bore 72 defined on the foot 26. In one example, a first and second spring 74 and 76 may be disposed within the nosepiece 22 and the foot 26, respectively, for biasing the fastener magazine 30 in a direction away from the housing 12.

The horizontal magazine housing 54 can define a fastener channel 80 for guiding the fasteners 44 toward the nosepiece 22. The fastener channel 80 may define a rail 82 configured to receive a head, collectively referred to at reference number 84, of a fastener 44. A driving bore 88 and a firing slot 90 may be defined at the forward end 62 of the horizontal magazine housing 54. In one example, the firing slot 90 may define a partial circumferential wall substantially consistent with an outer profile of the head of the forward-most fastener 16A. A stabilizing surface 94 can be defined at the forward end 62 of the horizontal magazine housing 54. The stabilizing surface 94 can be substantially perpendicular to an axis L3 of the first piston 60 (and therefore an axis L4 of the forward-most fastener 16A). A stop 96 may be formed on the horizontal magazine housing 54 at the forward end 62. A pusher (not shown) can be slidably disposed within the horizontal magazine housing 54 for urging the fasteners 44 toward the forward end 62 of the horizontal magazine housing 54. In one example, the pusher may be biased toward the forward end 62 of the horizontal magazine housing 54.

The trigger assembly 34 (FIG. 9) can have a main trigger 100 pivotally attached to the housing 12 or the handle 20 via a first pin 102, and a supplemental trigger 106 pivotally attached to the main trigger 100 via a second pin 108. A contact trip assembly 110 (FIG. 10) can have an upper contact trip 112 for contacting the supplemental trigger 106, a lower contact trip 114, and an adjuster 116 interposed between the upper contact trip 112 and the lower contact trip 114. The adjuster 116 can change an offset between the upper contact trip 112 and the lower contact trip 114 thus altering the effective length of the contact trip assembly 110. In this way a user can control the depth that the fastening tool drives a fastener into the workpiece 46. The upper contact trip 112 can move in response to axial movement of the lower contact trip 114 to activate the supplemental trigger 106. When the main trigger 100 and the upper contact trip 112 are activated, the supplemental trigger 106 will move a valve 120, thus activating the driving mechanism 14.

As will be described, the contact trip assembly 110 can be slidably attached to the housing 12 and/or the nosepiece 22 so that it slides vertically (as viewed in the FIGS. 9 and 10) upon engagement of a distal tip 122 of the fastener 16A with a workpiece 46 and subsequent movement of the handle 20 toward the workpiece 46. According to the present teachings, the first piston 60 of the fastener magazine 30 acts as the lower contact trip 114. The lower contact trip 114 therefore can be slidably disposed along the nosepiece 22.

Figure 3:
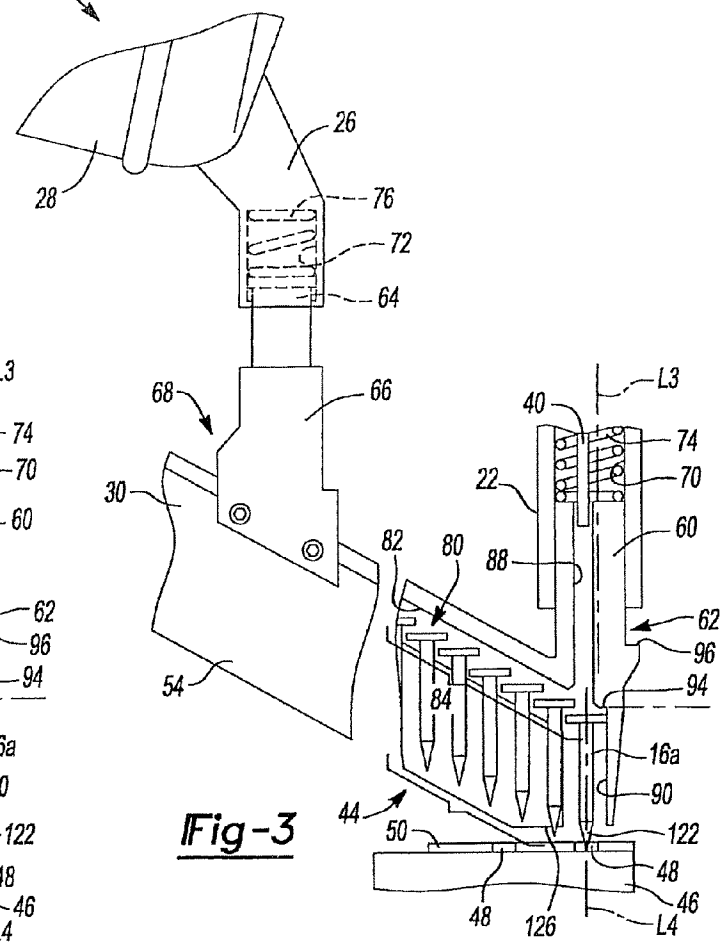
FIG. 3 is a partial perspective view of the fastener tool of FIG. 2 and shown in an alignment position wherein a distal tip of the forward-most fastener is located into a hole defined in the steel strap.

With reference now to FIGS. 2-8, a sequence of locating a fastener 44 at a hole 48 in the steel strap 50, and subsequently driving the fastener 44 into the workpiece 46 will be described. As illustrated in FIG. 2, the fastening tool 10 can be located generally above the workpiece 46 such that the forward-most fastener 16A is positioned generally above the steel strap 50 and a workpiece 46. Notably, the distal tip 122 of the fastener 16A extends beyond a lowermost surface 126 of the fastener magazine 30. Next, a user can move the fastening tool 10 into an alignment position (FIG. 3).

In the alignment position, the distal tip 122 of the fastener 16A is located into the hole 48 of the steel strap 50. Because the distal tip 122 of the fastener 16A extends proud from the bottom of the fastener magazine 30, a user can utilize the fastener 16A itself to positively locate the distal tip 122 of the fastener 16A into the hole 48 of the steel strap 50. Once the distal tip 122 has been positioned into the hole 48 of the steel strap 50, a user can advance the handle 20 (FIG. 1), and therefore the housing 12, of the fastening tool 10 a first distance in a direction toward the workpiece 46. As a result, the head 84 of the forward-most fastener 16A positively locates against the stabilizing surface 94 of the horizontal magazine housing 54. Notably, during movement of the forward-most fastener 16A from the position shown in FIG. 2 to the position shown in FIG. 4, the head of the forward-most fastener 16A is guided along the firing slot 90 until reaching the stabilizing surface 94. When the head 84 of the forward-most fastener 16A locates against the stabilizing surface 94, the fastening tool 10 as a whole is further stabilized. The forward-most fastener 16A therefore is controlled in a smooth, linear manner along the longitudinal axis L3. Because of the reliable interface between the forward-most fastener 16A, firing slot 90, and stabilizing surface 94, the forward-most fastener 16A can be controlled and driven repeatably straight.

Figure 5:
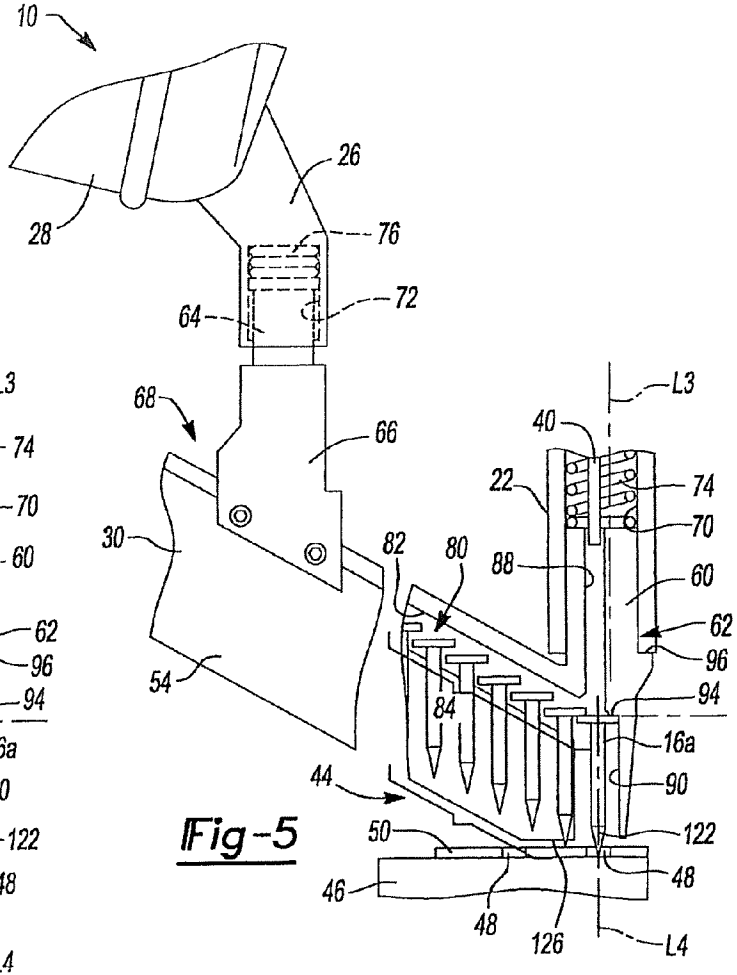
FIG. 5 is a partial perspective view of the fastener tool of FIG. 4 shown in an activation position with a first and a second piston collectively translated upwardly within a first bore defined on a nosepiece and a second bore defined on the foot of the fastener tool, respectively.
Figure 4:
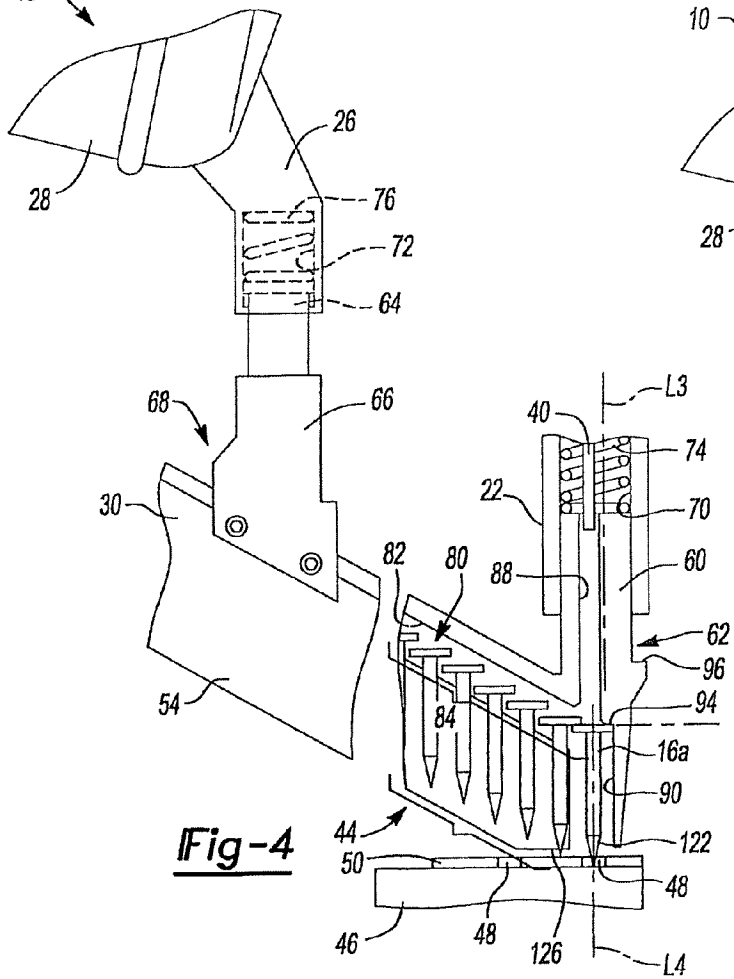
FIG. 4 is a partial perspective view of the fastener tool of FIG. 3 and shown with the fastening tool moved toward the steel strap until a head of the forward-most fastener engages a stabilizing surface defined on the magazine.
Figure 9:
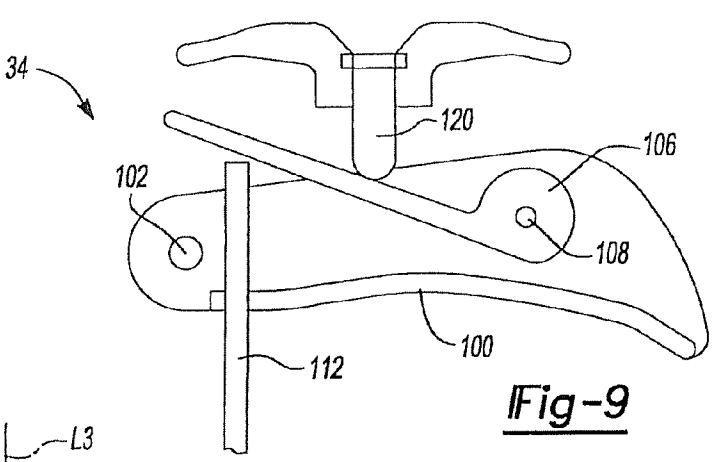
FIG. 9 is a partial cross-sectional view of a trigger assembly of the fastening tool of FIG. 1.
Figure 10:
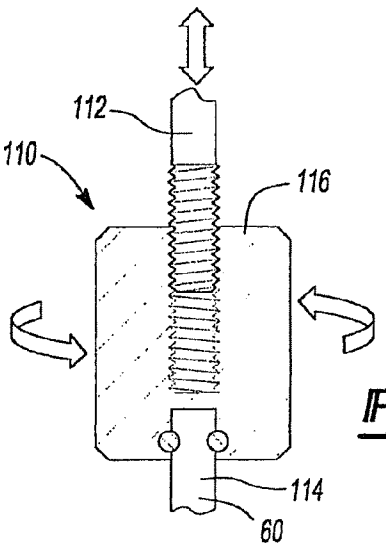
FIG. 10 is a partial cross-sectional view of an exemplary contact trip assembly of the fastening tool of FIG. 1.
Figure 8:
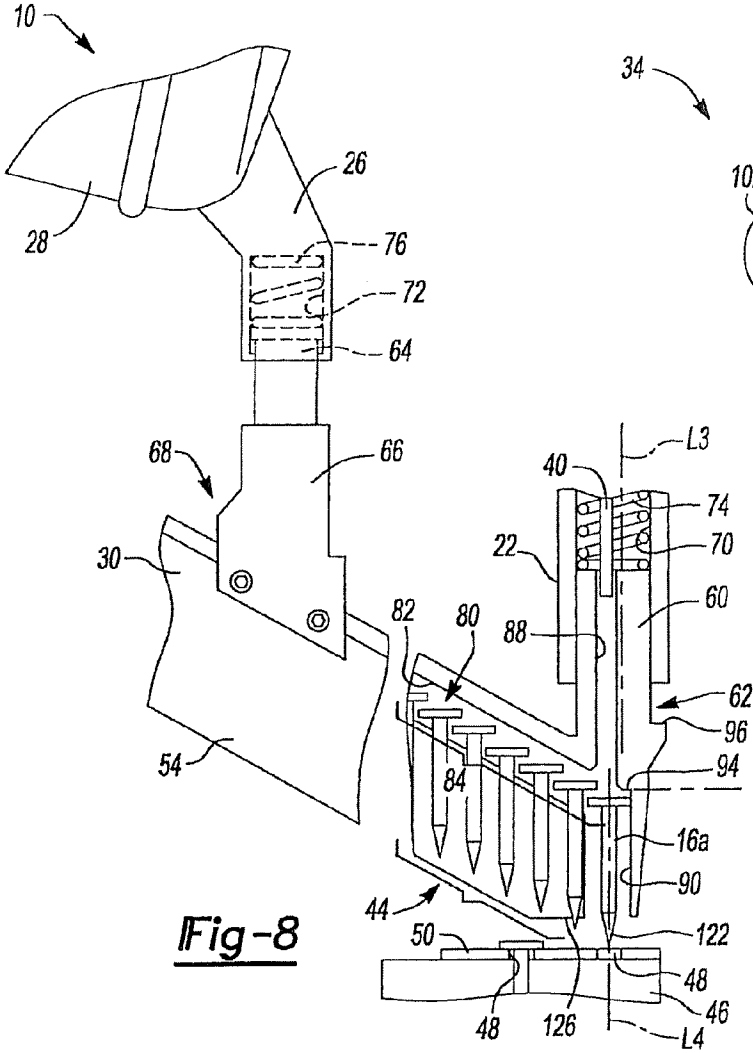
FIG. 8 is a partial perspective view of the fastener tool of FIG. 7 approaching a second hole in the steel strap.
Figure 11:
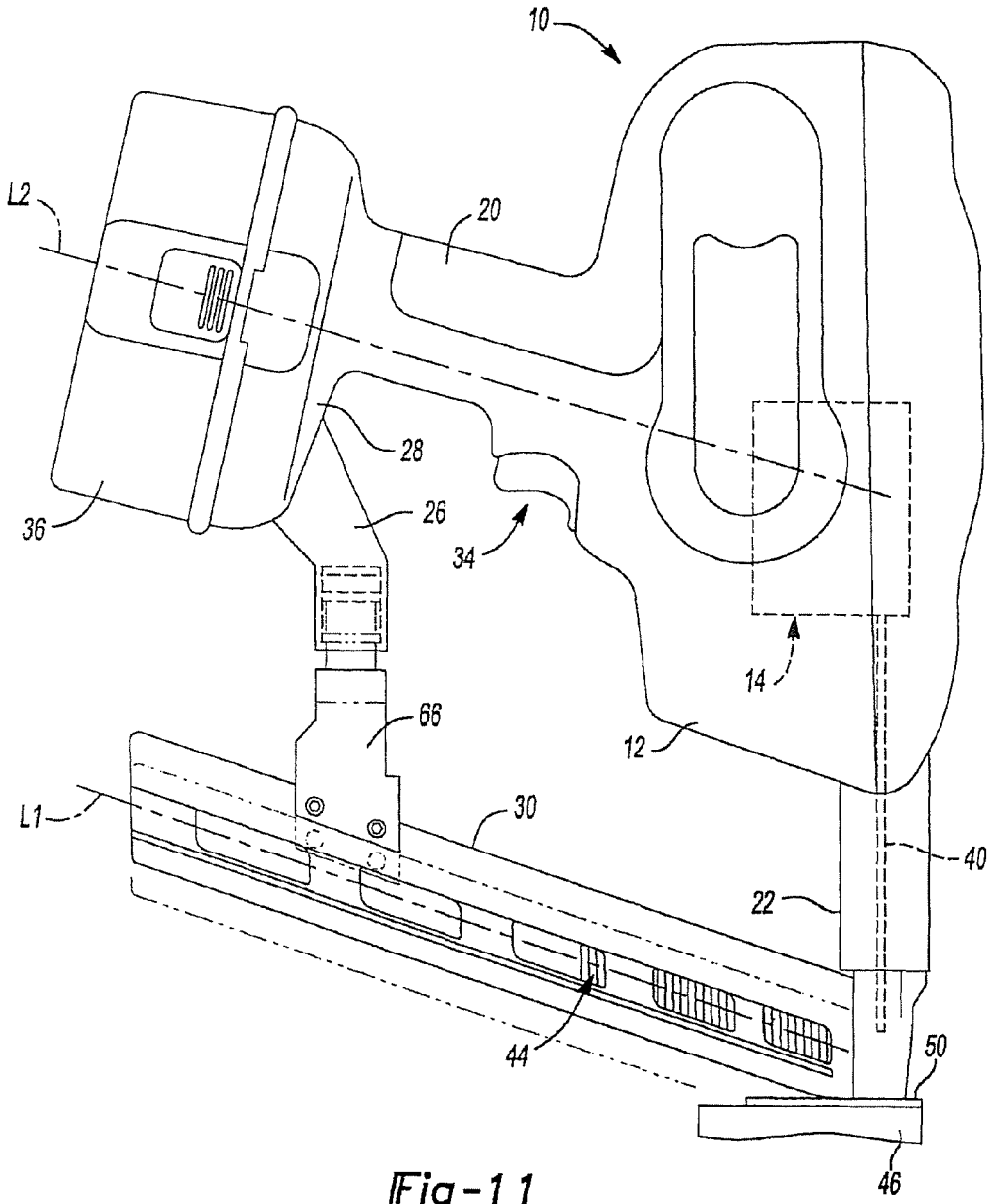
FIG. 11 is a perspective view of the fastening tool of FIG. 1 shown with the magazine in the alignment position (phantom line) and in the activation position (solid line).

Next, a user can further advance the handle 20 of the fastening tool 10 a second distance in a direction toward the workpiece 46 into an activation position (FIG. 5). As shown, the first and second pistons 60 and 64 can slidably retract collectively into the first and second bores 70 and 72, respectively. In one example, the fastener magazine 30 maintains a substantially parallel relationship upon movement of the fastener magazine 30 toward the housing 12 (see also FIG. 11). The fastener magazine 30 can retract until the stop 96 engages the nosepiece 22. It is appreciated at this point, the first piston 60 (acting as the lower contact trip 114) has advanced far enough to advance the upper contact trip 112 allowing the fastening tool 10 to fire upon actuation of the main trigger 100 (FIGS. 9 and 10).

Figure 7:
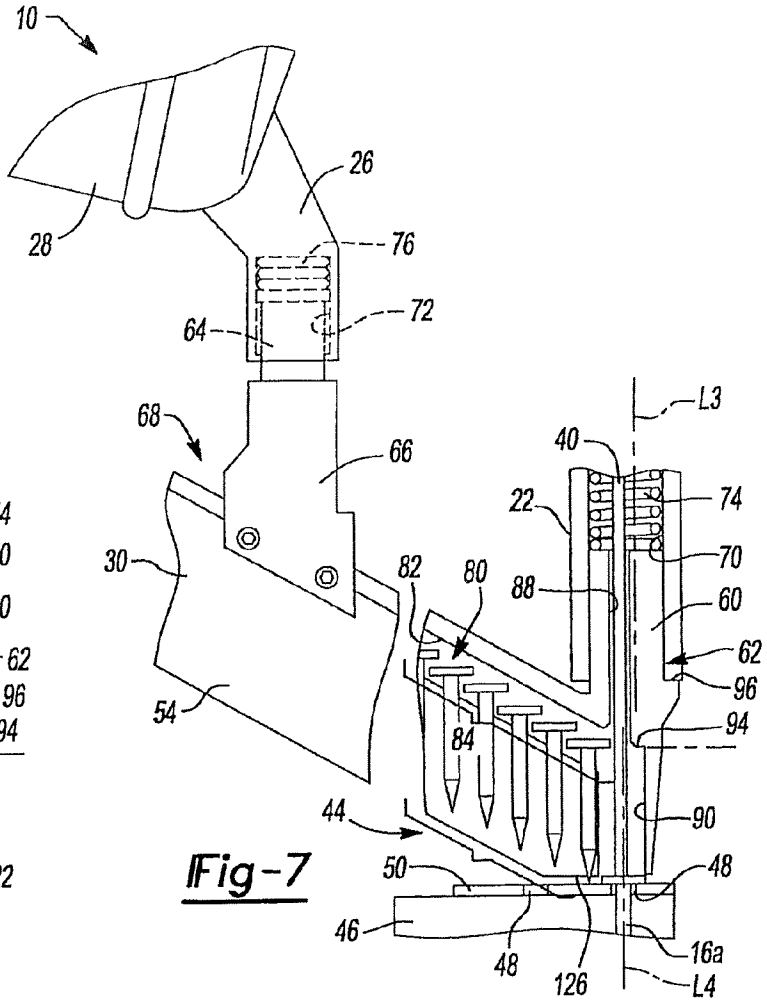
FIG. 7 is a partial perspective view of the fastener tool of FIG. 6 shown with the driver further advanced through the driving bore and driving the forward-most fastener to a final position.
Figure 6:
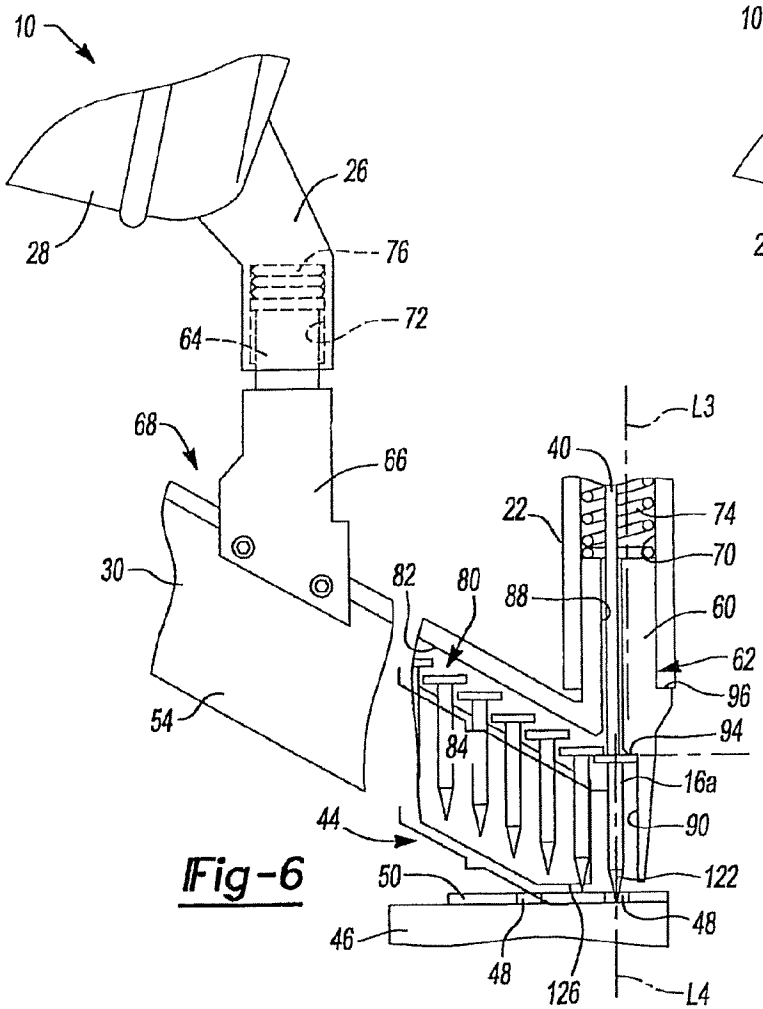
FIG. 6 is a partial perspective view of the fastener tool of FIG. 5 shown with a driver advancing through a driving bore in the first piston and striking the head of the forward-most fastener.

Turning now to FIG. 6, the trigger assembly 34 has been actuated such that the driver 40 is advanced through the driving bore 88 to engage the head 84 of the forward-most fastener 16A. As shown in FIG. 7, the driver 40 can be advanced fully such that the forward-most fastener 16A can be driven through the hole 48 in the steel strap 50 and ultimately into the workpiece 46. A user can then withdraw the fastening tool 10 from the workpiece 46 and prepare for driving the next fastener 44. As the user withdraws the fastening tool 10 from the workpiece 46, the springs 74 and 76 can urge the fastener magazine 30 away from the housing 12.

With reference to FIGS. 12-14 a power tool 210 according to additional features is shown. The power tool 210 can include a nosepiece 212 having a jaw assembly 214 coupled thereto. The power tool 210 can also incorporate a contact trip assembly (such as the contact trip assembly 110 shown in FIG. 10) that communicates with a trigger assembly (such as the trigger assembly 34 shown in FIG. 9). The jaw assembly 214 can include a first and a second jaw 220 and 222 pivotally attached at a pivot joint 224. Of note, a distal tip 230 of the jaw assembly 214 extends beyond a lowermost point of the nosepiece 212. As shown in FIG. 12, the jaw assembly 214 is in an alignment position wherein the first and second jaws 220 and 222 are closed. As a result, a user can manipulate the distal tip 230 of the jaw assembly 214 into the hole 48 of the steel strap 50. Once the distal tip 230 partially nests into the hole 48, the fastening tool 210 can be positively located at the desired position for driving a fastener 244 through the hole 48. At this point, the nosepiece 212 can be advanced as is known in the art to the position shown in FIG. 12.

The fastening tool 210 can incorporate a trigger assembly such as the trigger assembly 34 described above for FIG. 9. Once a firing event has been activated (i.e. a trigger, not shown, has been actuated), a driver 248 drives the fastener 244 toward the workpiece 46 (FIG. 13), and ultimately into the workpiece 46 to a final position (FIG. 14). As the fastener 244 is driven toward the workpiece 46, an annular surface 250 of a head 252 of the fastener 244 advances along inner surfaces 256 and 258 of the respective first and second jaw members 220 and 222. The advancement of the head 252 along the inner surface 256 and 258 urges the respective first and second jaw members 220 and 222 to pivot outwardly. Because both the first and second jaw members pivot about the same axis (i.e. about the pivot joint 224), they open up in a direction away from a surface of the workpiece 46. While the inner surfaces 256 and 258 are shown generally parallel to each other (FIG. 12), they may be configured differently such as angled surfaces that converge at the distal tip 230. A biasing member 260 can urge the jaw members 220 and 222 back to the position shown in FIG. 12 when the fastening tool 210 is lifted away from the driven fastener 244 and the workpiece 46.

While the disclosure has been described in the specification and illustrated in the drawings with reference to various embodiments, it will be understood by those skilled in the art that various changes may be made and equivalents may be substituted for elements thereof without departing from the scope of the disclosure as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. Moreover, many modifications may be made to adapt a particular situation or material to the teachings of the disclosure without departing from the essential scope thereof. Therefore, it is intended that the disclosure not be limited to the particular embodiment illustrated by the drawings and described in the specification as the best mode presently contemplated for carrying out this disclosure, but that the disclosure will include any embodiments falling within the foregoing description and the appended claims.

What is claimed is:

1. A fastening tool comprising:

a housing comprising a nosepiece and a handle, the handle defining a first longitudinal axis;

a magazine connected to the housing for storing a fastener, the magazine defining a firing slot and a stabilizing surface, the magazine further defining a second longitudinal axis that is substantially parallel to the first longitudinal axis and a fastener channel for receiving a fastener, the magazine movable relative to the housing between an alignment position wherein a distal tip of the fastener engages a workpiece and an activation position wherein the magazine moves toward the housing upon movement of the handle toward the workpiece, wherein the fastener is guided along the firing slot to an engaged position with the stabilizing surface while the distal tip of the fastener remains engaged to the workpiece during initial movement of the handle toward the workpiece through a first distance from the alignment position to a position where the fastener is at the engaged position with the stabilizing surface, and wherein the handle is configured to subsequently move toward the stabilizing surface through a second distance to the activation position, wherein the fastener moves relative to the firing slot during movement of the handle through the first distance and is fixed relative to the firing slot during movement of the handle through the second distance;

a driving mechanism disposed within the housing that advances through the firing slot for driving the fastener into a workpiece; and a trigger assembly coupled to the housing for activating the driving mechanism upon actuation of a primary trigger and movement of the magazine into the activation position, wherein movement of the magazine into the activation position is caused by interaction of the fastener on the stabilizing surface while the handle is moved toward the workpiece.

2. The fastening tool of claim 1 wherein said first and second longitudinal axes maintain a substantially parallel relationship upon movement of the magazine toward the housing.

3. The fastening tool of claim 1 wherein the fastener channel is at least partially defined by a rail configured to receive a head of the fastener.

4. The fastening tool of claim 3, further comprising a series of fasteners wherein the fastener defines a forward-most fastener of the series of fasteners and wherein the stabilizing surface engages only the forward-most fastener of the series of fasteners in the activation position.

5. The fastening tool of claim 4 wherein the stabilizing surface is substantially perpendicular to an axis defined by the fastener.

6. The fastening tool of claim 5 wherein initial contact of a distal end of the fastener with the workpiece and subsequent movement of the handle toward the workpiece causes the head of the fastener to move toward the stabilizing surface a distance prior to movement of the magazine into the activation position.

7. The fastening tool of claim 1 wherein the magazine is biased into the alignment position.

8. The fastening tool of claim 1 wherein one of the nosepiece or the magazine defines a first bore and the other of the nosepiece or the magazine defines a first piston, the first piston slidably translating within the first bore along a third longitudinal axis during movement of the magazine between the alignment position and the activation position.

9. The fastening tool of claim 8 wherein the fastening tool defines a foot that cooperates with a strut configured on a rearward end of the magazine offset from the nosepiece and wherein one of the foot or the magazine defines a second bore and the other of the foot or the magazine defines a second piston, the second piston slidably translating within the second bore along a fourth longitudinal axis during movement of the magazine between the alignment position and the activation position, wherein the third and fourth axes are parallel and offset relative to each other.

10. The fastening tool of claim 1 wherein the magazine defines a stop member that engages structure on the nosepiece upon movement of the magazine to the activation position and wherein the stop member inhibits further withdrawal of the magazine relative to the nosepiece.

11. The fastening tool of claim 1 wherein the firing slot and the stabilizing surface are fixed relative to each other.

12. A fastening tool comprising:

a housing comprising a nosepiece and a handle, the handle defining a first longitudinal axis;

a magazine connected to the housing for storing a fastener, the magazine defining a firing slot and a stabilizing surface, the magazine further defining a second longitudinal axis having a predetermined angular relationship with the first longitudinal axis, and a fastener channel for receiving a fastener, the magazine movable relative to the housing between an alignment position wherein a distal tip of the fastener engages a workpiece and an activation position wherein the magazine moves toward the handle and maintains said predetermined angular relationship upon movement of the handle toward the workpiece, wherein a head of the fastener is guided along the firing slot to an engaged position with the stabilizing surface during initial movement of the handle toward the workpiece through a first distance from the alignment position to a position where the fastener is at the engaged position with the stabilizing surface, and wherein the handle is configured to subsequently move toward the stabilizing surface through a second distance to the activation position, wherein the head of the fastener urges the magazine to advance into the activation position while in the engaged position;

a driving mechanism disposed within the housing that advances through the firing slot for driving the fastener into a workpiece; and a trigger assembly coupled to the housing for activating the driving mechanism upon movement of the magazine into the activation position.

13. The fastening tool of claim 12 wherein said predetermined angular relationship includes a substantially parallel relationship.

14. The fastening tool of claim 12 wherein the fastener channel is at least partially defined by a rail configured to receive a head of the fastener.

15. The fastening tool of claim 14, further comprising a series of fasteners wherein the fastener defines a forward-most fastener of the series of fasteners and wherein the stabilizing surface engages only the forward-most fastener of the series of fasteners in the activation position.

16. The fastening tool of claim 15 wherein the stabilizing surface is substantially perpendicular to an axis defined by the fastener.

17. The fastening tool of claim 16 wherein initial contact of a distal end of the fastener with the workpiece and subsequent movement of the handle toward the workpiece causes the head of the fastener to move toward the stabilizing surface a distance prior to movement of the magazine into the activation position.

18. The fastening tool of claim 12 wherein the magazine is biased into the alignment position.

19. The fastening tool of claim 12 wherein one of the nosepiece or the magazine defines a first bore and the other of the nosepiece or the magazine defines a first piston, the first piston slidably translating within the first bore along a third longitudinal axis during movement of the magazine between the alignment position and the activation position.

20. The fastening tool of claim 19 wherein the fastening tool defines a foot and wherein one of the foot or the magazine defines a second bore and the other of the foot or the magazine defines a second piston, the second piston slidably translating within the second bore along a fourth longitudinal axis during movement of the magazine between the alignment position and the activation position, wherein the third and fourth axes are parallel and offset.

21. The fastening tool of claim 12 wherein the magazine defines a stop member that engages structure on the nosepiece upon movement of the magazine to the activation position and wherein the stop member inhibits further withdrawal of the magazine relative to the nosepiece.

22. The fastening tool of claim 12 wherein the firing slot and the stabilizing surface are fixed relative to each other.

23. A fastening tool comprising:

a housing comprising a nosepiece and a handle;

a magazine connected to the housing for storing a fastener, the magazine defining a firing slot and a stabilizing surface, and a fastener channel for receiving a fastener, the magazine movable relative to the housing between an alignment position wherein a distal tip of the fastener engages a workpiece and an activation position wherein the magazine moves toward the handle, wherein a head of the fastener is guided along the firing slot to an engaged position with the stabilizing surface during initial movement of the handle toward the workpiece through a first distance from the alignment position to a position where the fastener is at the engaged position with the stabilizing surface, and wherein the handle is configured to subsequently move toward the stabilizing surface through a second distance to the activation position, wherein the head of the fastener urges the magazine to advance into the activation position while in the engaged position.

24. The fastening tool of claim 23 wherein the fastener moves relative to the firing slot during movement of the handle through the first distance and is fixed relative to the firing slot during movement of the handle through the second distance.

25. The fastening tool of claim 23, further comprising:

a driving mechanism disposed within the housing that advances through the firing slot for driving the fastener into a workpiece; and a trigger assembly coupled to the housing for activating the driving mechanism upon movement of the magazine into the activation position.

* * * * *